United States Patent [19]

Dysarz

[11] Patent Number: 4,714,110

[45] Date of Patent: Dec. 22, 1987

[54] DEVICE TO RELIEVE SUCKER ROD TORQUE BELOW GROUND LEVEL IN A PETROLEUM WELL

[76] Inventor: Edward D. Dysarz, 11423 Triola La., Houston, Tex. 77072

[21] Appl. No.: 893,991

[22] Filed: Aug. 7, 1986

Related U.S. Application Data

[63] Continuation-in-part of Ser. No. 668,515, Nov. 4, 1984, Pat. No. 4,676,311.

[51] Int. Cl.[4] ..... E21B 17/10; F16D 1/12

[52] U.S. Cl. ..... 166/68; 166/241; 403/60; 403/78; 403/165

[58] Field of Search ..... 166/241, 68, 105; 175/325; 403/60, 78, 165

[56] References Cited

U.S. PATENT DOCUMENTS

| | | | |
|---|---|---|---|
| 713,723 | 11/1902 | Vinzent | 175/325 |
| 1,281,756 | 10/1918 | Black | 175/325 |
| 1,516,891 | 11/1924 | Pridgen | 403/165 |
| 1,550,069 | 8/1925 | Goolsby et al. | 403/78 |
| 1,574,187 | 2/1926 | Crickmer | 403/78 |
| 1,765,279 | 6/1930 | Leverich | 403/165 |
| 1,827,835 | 10/1931 | Black | 175/325 |
| 2,132,477 | 10/1938 | Hollyfield | 403/78 |
| 2,198,720 | 4/1940 | Edgecomb et al. | 175/325 |
| 4,621,690 | 11/1986 | Klyne | 166/241 |

*Primary Examiner*—Stephen J. Novosad
*Assistant Examiner*—Bruce M. Kisliuk

[57] ABSTRACT

A torque relief device for use on sucker rod pumps that relieves sucker rod torque deep in the well. Although the device will relieve torque for all sucker rod pumps it will be most effective for use in long stroke sucker rod pumps; further although the device will be effective on all sucker rod pumped wells, it will be most effective on deviated wells where sucker rod torque is the greatest. The device includes a square tube fixed within the well. Inside of the square tube a wheeled rod guide moves up and down with the sucker rods but is restrained from rotating by the wheels reacting with the tube. At each end of the wheeled rod guide is a swivel that allows the sucker rod to rotate thus dissipating the sucker rod torque.

4 Claims, 7 Drawing Figures

DEVICE TO RELIEVE SUCKER ROD TORQUE BELOW GROUND LEVEL IN A PETROLEUM WELL

CROSS REFERENCE TO RELATED APPLICATIONS

Continuation-in-part of U.S. patent application Ser. No. 668,515 filed 11/4/84 now U.S. Pat. No. 4,676,311 of Edward David Dysarz which is incorporated here and by reference.

BACKGROUND OF THE INVENTION

1. Field of the Invention

The present invention relates to sucker rod pumps and more particularly to long stroke sucker rod pumps and sucker rod pumps in deviated petroleum wells.

2. Description of Prior Art

Pumping petroleum, water and other minerals with sucker rods and sucker rod pumps is an old and well used method of extraction of liquid minerals from the earth. In the past, most sucker rod pumped wells were almost vertical or would deviate from vertical by no more than eight degrees or ten degrees. With this relatively minor deviation in the well there is little or no torque caused by sucker rods rubbing and twisting inside of the tubing and therefore this problem was not addressed to any great extent. If the problem did exist, there would be a swivel added to the carrier bar of the pumping unit, or the two wire lines on the horsehead would be sufficient to counter any torque that may exist.

There are two recent changes in the art of petroleum pumping that now are causing greater torque to be placed on the sucker rod string. One change has been with the increased use of long stroke pumping devices that have sucker rod strokes ranging from fifteen feet to one hundred feet. The other change has been the addition of rod guides to sucker rod strings allowing sucker rods to be placed in wells with deviation of over ninety degrees; often these highly deviated wells look like cork screws when shown in plan view.

When pumping petroleum from these highly deviated wells the sucker rods will twist and turn causing torque on the rod string. Some of the torque is relieved in the downhole pump, with the rest of the torque being relieved in a swivel on the carrier bar of the surface pump. Often on long stroke pumps the torque is allowed to twist a single cable which could cause the individual strands or wires that make up the cable to rub or chafe and then break down. One long stroke pumping unit that has a single cable running into the well is the GAULT unit with a U.S. Pat. No. 4,062,640, issued on Dec. 13, 1977 .

Other long stroke pumps use chains rather than cables and arrests the torque with roller guides. The problem with the method of arresting torque with roller guides is that the chain will twist below the roller guides thus causing the chain to wear out more rapidly due to the twist in the chain and the greater wear on one side as the chain passes over the roller guides. If the mechanical chain is put into any torque it will wear out more rapidly.

There are two pumping devices that guide the mechanical chain with roller guides as noted: they are James, with a patent issued on Apr. 15, 1980, U.S. Pat. No. 4,197,766 and Chardonneau et al, with a patent issued on Dec. 20, 1977, U.S. Pat. No. 4,063,827. These devices teach the resistance of torque on a sucker rod string after the torque reaches the cable chain or polished rod thus causing more wear and stress on the chain.

SUMMARY OF THE INVENTION

The present invention is a highly effective device that will relieve any torque from the sucker rod string before it reaches the polished rod, cable or chain of a pumping unit.

It is a particular object of the invention to relieve torque in long stroke pumping units or in highly deviated wells.

It is still another object of this invention to extend the life of the mechanical chain and or cable of long stroke sucker rod pumps.

It is yet another object of this invention to relieve torque and the effects of torque on a sucker rod string with a device inside of the well itself, not a device above the well or well head, thus allowing along stroke pump to operate inside of the well not above the well.

It is also another object of this invention to resist torque in a sucker rod string.

THE DRAWINGS

For further understanding of the nature and objects of the present invention, reference should be had to the following detailed description of the preferred embodiments thereof, taken in conjunction with the accompanying drawings, in which like parts are given like reference numerals and wherein.

DETAILED DESCRIPTION OF THE PREFERRED EMBODIMENT

The preferred embodiment of the device of the present invention may be used to relieve sucker rod torque in vertical wells and deviated wells.

The ability to relieve torque is accompalished by placing a roller guide with swivels on each end of said roller guide inside of a guide frame thus allowing the roller guide to move up and down while not allowing it to rotate. When torque is applied to the sucker rod string and further moves up the sucker rod string, the torque is dissipated by allowing the sucker rod string to rotate the swivel while the roller guide is held in place by the guide frame.

A particularly important application of the present invention is for use in highly deviated wells where sucker rod string torque exists. Another important application for the present invention is for long stroke pumps wherein most components of the pumps are placed inside of the well itself to allow the pump to maintain a low profile.

The preferred embodiment of the invention places more emphasis on the use with a long stroke pump but it could be applied to any pump that utilizes sucker rods.

DEVICE AND ITS METHOD OF USE

Figure 1:
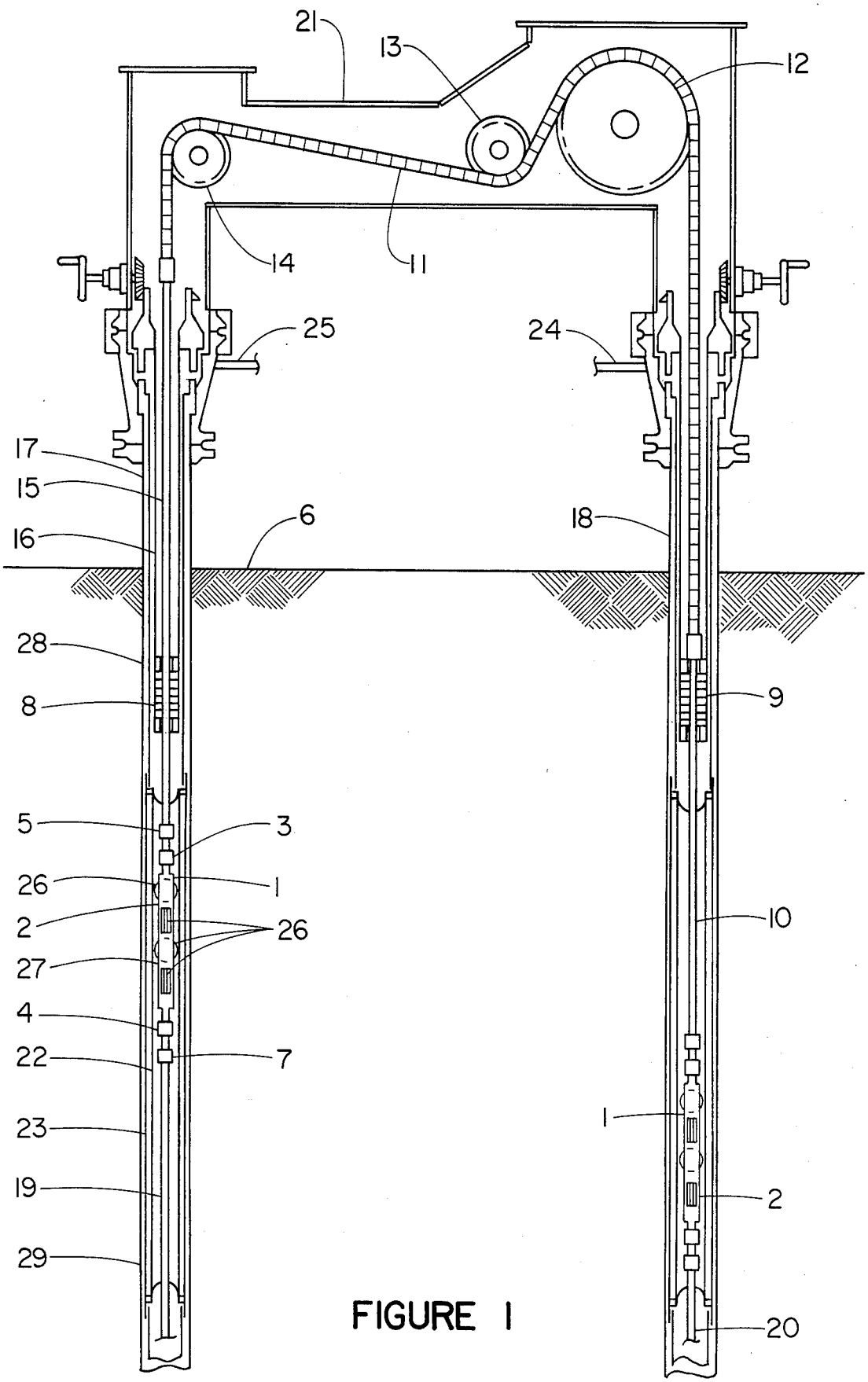
FIG. 1 is an elevation of a long stroke pump with two wells and two torque relief guides.

Referring to FIG. 1 there is shown the device 1 on a two well counter balanced pump 21.

The two well counter balance pump 21 is a long stroke pump that utilizes the weight of the sucker rod string 20 of a right well 18 to offset the weight of the left sucker rod string 19 of a left well 17. The right sucker rod string 20 of the right well 18 is suitably fastened to the roller guide 2 that is further fastened to the right polished rod 14 that is pulled through the right stuffing box 9 where the right polished rod 10 is suitably fastened to a mechanical chain 11. The mechanical chain 11 is run over a drive sprocket 12 under another sprocket 13 and over still another sprocket 14 where it descends into the left well 17 where the mechanical chain 11 is suitably fastened to the left polished rod 15. The left polished rod 15 passes through the left stuffing box 8 where it is suitably fastened to another roller guide 2. The roller guide 2 is further fastened to the left sucker rod string 19 that descends into the left well 17.

To operate this type of pump the drive sprocket 12 rotates in a counter clockwise direction, pulling up on the right polished rod 10, roller guide 2 and right sucker rod string 20 which pulls up the petroleum or other fluid and causes the petroleum to be discharged through the right petroleum discharge 24. At the same time that the right sucker rod string 20 is moving upward, the left sucker rod string 19 is moving downward.

When the right sucker rod string 20 has reached the desired height, the drive sprocket 12 reverses to turn in a clockwise direction, which causes the right sucker rod string 20 to descend and the left sucker rod string to ascend thus causing the petroleum to flow up the left well 17 and out of the left petroleum outlet.

In order to better describe the "Device to Relieve Sucker Rod Torque", only the left well 17 will be used.

Still referring to FIG. 1 there is shown the roller guide 2 with a top swivel 3 and a bottom swivel 4 each swivel is suitably fastened to the roller guide 2 and will be described in greater detail in FIG. 6. The top swivel 3 is suitably fastened to the polished rod 15 by a top coupling 5 and the bottom swivel 4 which is suitably fastened to the sucker rod string 19 by a lower coupling 7.

The roller guide 2 moves up and down inside of a guide frame 22 that is suitably held in place inside of the tubing 23. The roller guide 2 is held in place inside of the guide frame 22 by four sets of double rollers 26 that are suitably fastened to the body 27 of the roller guide 2.

Figure 2:
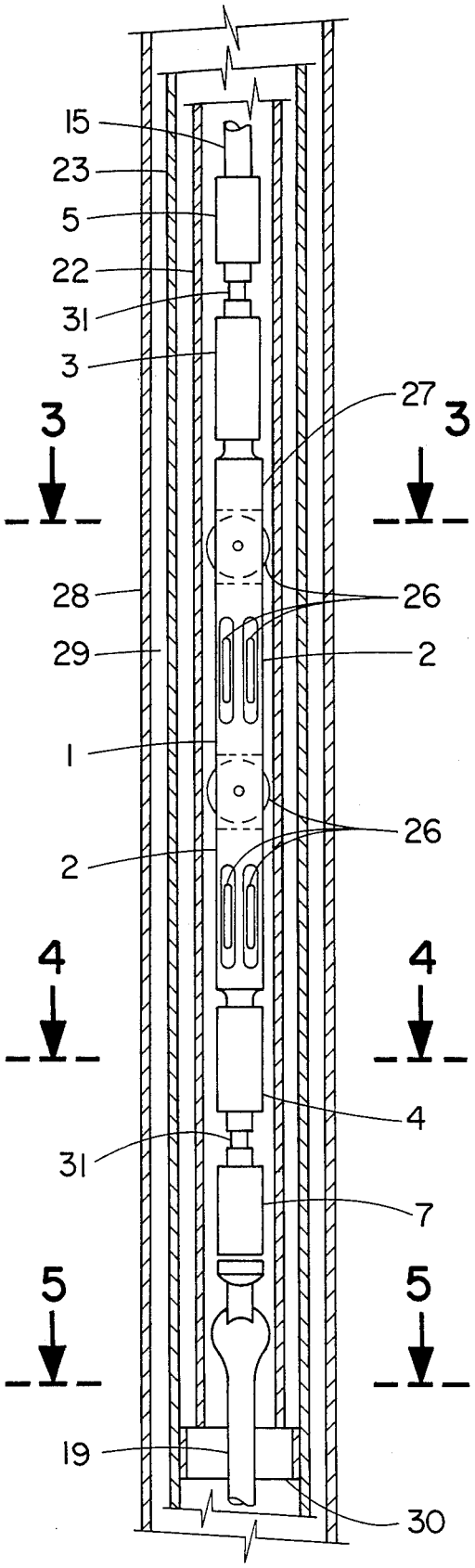
FIG. 2 is an enlarged elevation of one well with a torque relief guide.

Referring to FIG. 2 there is shown an enlarged elevation of the device 1 inside of a well 17.

On the outside is the well casing 28 with the gas annulus 29 inside of the well casing 28. Inside of the gas annulus 29 is the tubing 23. The petroleum or other fluid flows inside of the tubing 23. Also shown inside of the tubing 23 is the guide frame 22.

Inside of the guide frame 22 is the roller guide 2 with four sets of rollers 26. Each set of rollers 26 is rotated 90° from the other set; which allows the rollers 26 to roll on the inside of the guide frame 22 on four sides. The diameter of the rollers 26 is slightly less than the inside width of the guide frame 22.

At the top of the roller guide 2 is the polished rod 15 which is fastened to the top swivel 3 of the roller guide 2 with the top coupling 5. Below the top coupling 5 is a wrench flat 31 which allows the top coupling 5 to be fastened and tightened to the top swivel 3. The top swivel 3 allows for some rotation of the polished rod 15 and the chain 11 not shown or the cable also not shown. The top swivel 3 is threaded onto the body 27 of the roller guide 2.

At the bottom of the roller guide 2 body 27 is the bottom swivel 4 which allows the sucker rod string 19 to rotate. The bottom swivel 4 has a wrench flat 31 that allows the bottom swivel 4 to be fastened and tightened to the lower coupling 7. The lower coupling 7 fastens the bottom swivel 4 to the sucker rod string 19 which runs deep into the well 17. There is also a wrench flat 31 at the lower end of the bottom swivel 7.

At the lower end of the device 1 is the guide frame foundation 30 which is suitably fastened to the tubing 23 by welding or bolting or riveting or some other suitable means. The guide frame 23 is supported on the guide frame foundation 30 and is also held in place to resist any torque from the sucker rod string 19 that may be transfered into the roller guide 2.

Figure 3:
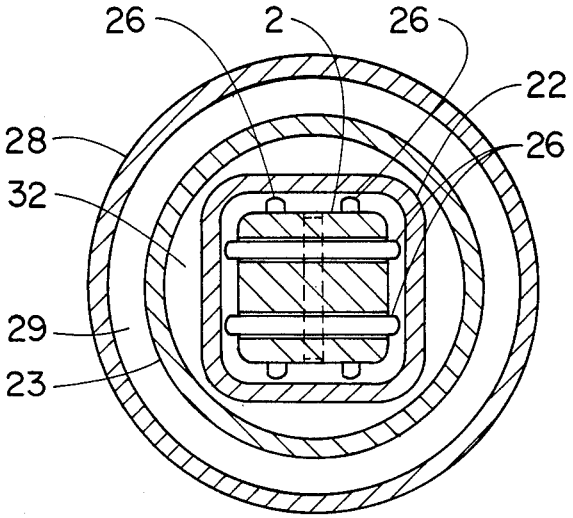
FIG. 3 is a section taken through FIG. 2.

Referring to FIG. 3 there is shown a section taken through FIG. 2.

The outer pipe is the well casing 28. Inside of the well casing 28 is the gas annulus 29, and inside of the gas annulus 29 is the tubing 23.

Shown inside of the tubing 23 is the guide frame 22 which is a square tube. The roller guide 2 is inside of the guide frame 22. The roller guide 2 is shown with two rollers 26 placed in one direction and two more rollers 26 placed 90° to the first two rollers 26. The rollers 26 are held in place on the body 27 by an axel 32.

Figure 4:
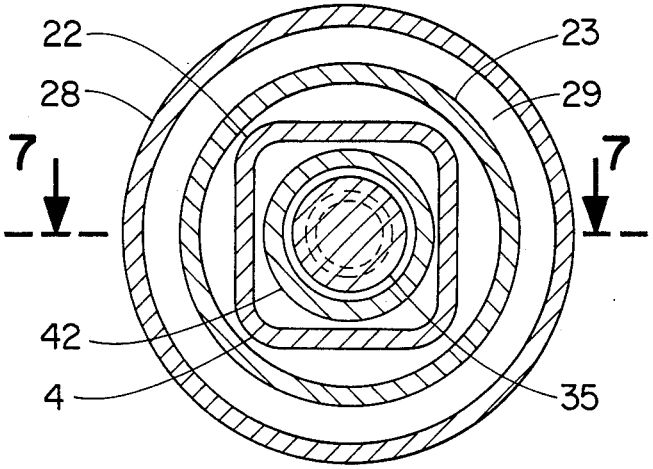
FIG. 4 is a section taken through FIG. 2.

Referring to FIG. 4 there is shown another section taken through FIG. 2.

The outer pipe is the well casing 28. Inside of the well casing 28 is the gas annulus 29, and inside of the gas annulus 29 is the tubing 23.

Shown inside of the tubing 23 is the swivel body 33 of the bottom swivel 4 and the stem thrust flange 35. This will be explained in greater detail in FIGS. 6 and 7.

Figure 5:
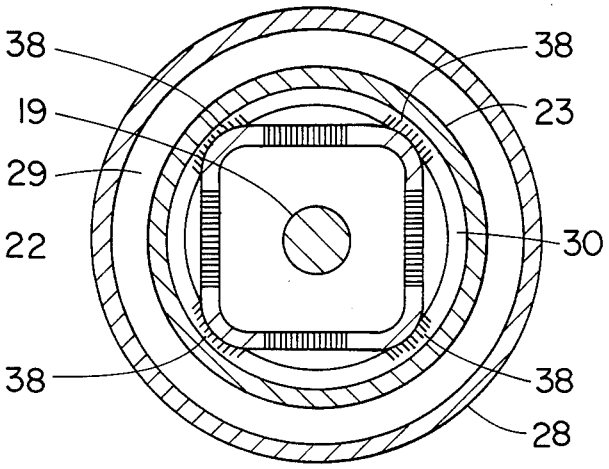
FIG. 5 is another section taken through FIG. 2.

Referring to FIG. 5 there is shown still another section taken through FIG. 2.

The outer pipe is the well casing 28. Inside of the well casing 28 is the gas annulus 29, and inside of the gas annulus 29 is the tubing 23.

Suitably fastened inside of the tubing 23 is the guide frame foundation 30 that supports the guide frame 22. The guide frame 22 is suitably fastened to the guide frame foundation 30 by welds 38 but it could be fastened with other means by design choice. There is also a similar guide frame foundation 30 at the top of the guide frame 22.

Shown inside of the guide frame 22 is the sucker rod string 19.

Figure 6:
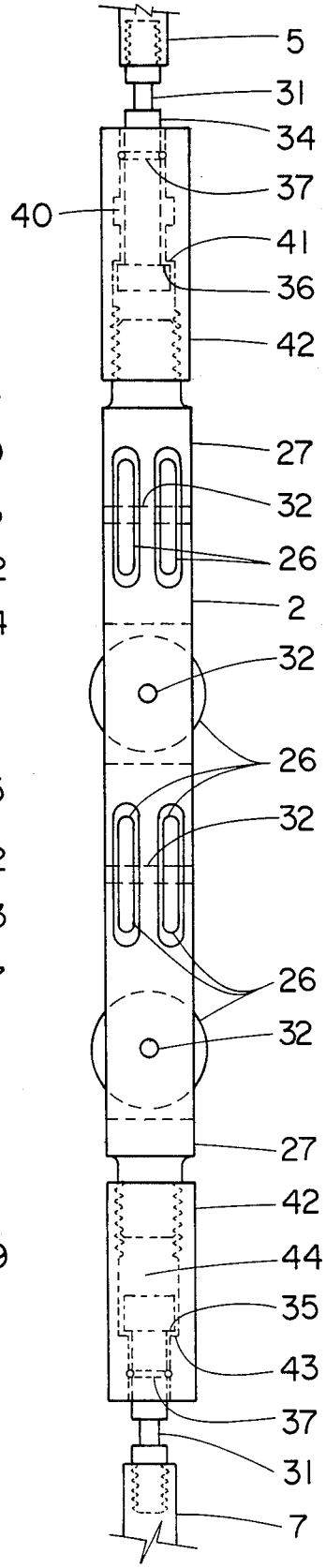
FIG. 6 is an elevation of the roller guide.

Referring to FIG. 6 there is shown another enlarged enlongation of the roller guide 2.

At the top of the roller guide 2 is the top coupling 5 that is threaded onto the upper swivel stem 34. There is a wrench flat 31 on the upper swivel stem 34 to allow the upper swivel stem 34 to be tightened with a wrench to the top coupling 5.

Inside of the swivel body 33 is an 'O' ring seal 37 that seals off crude oil or other fluids in the well 17 and prevents them from entering into interior section of the top swivel 3. The top swivel 3 may also contain lube oil in a small upper lube oil chamber 40 which contains lube oil that is also held in place with the 'O' ring seal 37. At the lower end of the upper swivel stem 34 is the upper thrust flange 41 that pushes against the upper body thrust flange 36. These flanges are covered with lube oil and rub against each other as the upper swivel stem 34 rotates. Although it is not shown, there may also be a bearing in this area or there could also be several teflon coated rub rings in this area that would allow the upper swivel stem 34 to rotate freely.

The swivel body 33 is threaded onto the body 27 of the roller guide 2. The body 27 of the roller guide 2 supports the rollers 26 on axles 32. The rollers 26 are made up of nylon, plastic or metal which would be a matter of design choice.

The lower end of the body 27 is threaded onto the lower swivel body 42. Inside of the lower swivel body 42 there is the lower swivel body thrust flange 43 that pushes and supports the lower stem thrust flange 35. Further down there is another 'O' ring seal 37 that holds in the lube oil and keeps crude oil out of the lower lube oil chamber 44.

At the bottom of the lower swivel 39 is the wrench flat 31 and the threaded connection to the lower coupling 7.

Figure 7:
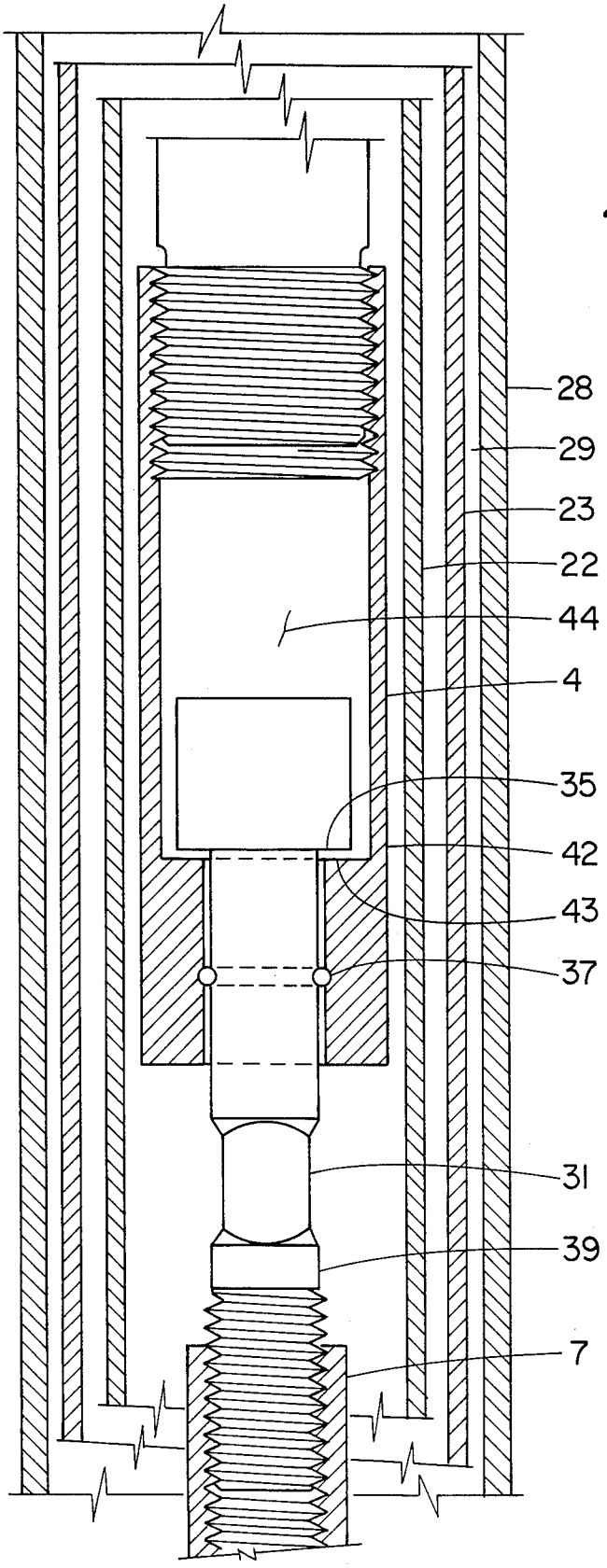
FIG. 7 is a section of the lower swivel.

Referring to FIG. 7 there is shown an enlarged section of the bottom swivel 4 taken through FIG. 4.

The outer pipe is the well casing 28. Inside of the well casing 28 is the gas annulus 29, and inside of the gas annulus is the tubing 23. Inside of the tubing 23 is the guide frame 22.

The lower part of the body 27 of the roller guide 2 is shown threaded into the lower swivel body 42 of the bottom swivel 4. Inside of the lower swivel body 42 is a lower lube oil chamber 44 that holds lube oil that will reduce the friction or lubricate the surface of lower swivel body thrust flange 93 as the lower stem thrust flange 35 rotates in the lower swivel body 42. There is also another 'O' ring seal 37 or some other suitable seal in the lower swivel stem 39 that will retain the lube oil and block the flow of well fluid into the lower lube oil chamber 44.

As shown, the lower swivel stem 39 has a wrench flat 31 that will allow the lower coupling 7 to be tightened with a wrench to the lower swivel stem 39. The coupling 7 is fastened to the sucker rod string 19 not shown in FIG. 7 but shown in FIG. 2.

Although the system described in detail supra has been found to be most satisfactory and preferred, many variations in the structure and method are possible. For example, there may only be two sets of wheels, each set of wheels placed at ninety degrees to each other. There may only be one set of wheels required and in other cases a square bar, may be run through a square guide and no wheels will be required at all. It could also be possible to place the rollers in single guides or tracks to prevent the roller guide from rotating.

The device could be used with any pump that utilizes a sucker rod such as a long stroke pump or a pump jack.

Although the invention has been described with reference to the preferred embodiment, it will be understood by those skilled in the art, that modifications, additions, substitutions, deletions and other changes not specifically described, may be made in the embodiment herein, it should be understood that the details herein are to be interpreted as illustrative and not in a limiting sense.

What is claimed as invention is:

1. An apparatus for use in a sucker rod string having a polished rod for relieving torque below said polished rod and inside of a well while said sucker rod string is moving up and down inside of said well, comprising:

a body, said body that is suitably fastened to the lower end of said polished rod;

at least one set of rollers that are suitably mounted within said body by axles, said rollers with a diameter greater than the width of said body;

a lower swivel, said lower swivel that is suitably fastened to the lower end of said body at the top of said lower swivel, said lower swivel is further suitably attached at the lower end of said body to the upper end of said sucker rod string, said lower swivel to isolate said sucker rod string from said body by allowing said sucker rod string to rotate freely without causing said body to rotate;

a guide, said guide being a tube that is square in section and is set vertically within said well, said guide is suitably fastened to said well at top and bottom of said guide, said guide to have an inside dimension that is slightly greater than the diameter of said rollers to allow said rollers to roll on the inside of said guide, said guide to restrain said rollers set and held within said body, allowing said body and rollers to move freely up and down within said guide while restraining said body and said rollers from rotating horizontally.

2. The apparatus of claim 1 wherein said apparatus has an upper swivel, said upper swivel that is suitably fastened to said polished rod at the top of said upper swivel and further suitably fastened to said body at the lower end of said upper swivel.

3. The apparatus of claim 1 wherein said apparatus has at least one lube oil chamber inside of the swivel.

4. The apparatus of claim 1 wherein said apparatus has rollers set ninety degrees apart.

* * * * *